US005920938A

United States Patent [19]

Elcock et al.

[11] Patent Number: 5,920,938

[45] Date of Patent: Jul. 13, 1999

[54] METHOD FOR REJUVENATING BRIDGE HINGES

[76] Inventors: Stanley E. Elcock, 6314 Eggert Rd.; Stanley D. Elcock, 5153 Cummings Rd., both of Eureka, Calif. 95503

[21] Appl. No.: 08/906,421

[22] Filed: Aug. 5, 1997

[51] Int. Cl.[6] ..... E01D 21/00; E01D 19/04

[52] U.S. Cl. ..... 14/77.1; 14/73.5

[58] Field of Search ..... 14/73, 73.1, 73.5, 14/74.5, 77.1; 52/394, 396.04, 396.1, 741.3

[56] References Cited

U.S. PATENT DOCUMENTS

| | | |
|---|---|---|
| 3,564,567 | 2/1971 | Mladyenovitch . |
| 3,685,224 | 8/1972 | Launay . |
| 5,566,414 | 10/1996 | Nonaka . |

FOREIGN PATENT DOCUMENTS

| | | |
|---|---|---|
| 423029 A1 | 4/1991 | European Pat. Off. . |
| 2544432 | 10/1984 | France . |
| 2576943 | 8/1986 | France . |
| 3919833 | 12/1990 | Germany . |
| 280110 | 11/1989 | Japan . |

*Primary Examiner*—Tamara Graysay
*Assistant Examiner*—Sunil Singh
*Attorney, Agent, or Firm*—Richard C. Litman

[57] ABSTRACT

A method for rejuvenating bridge hinges and bridge abutments for replacement of worn bridge bearing pads. The method can be applied to the insertion of heavy duty pipes for seismic retrofitting of joints in elevated roadways. Throughbores are drilled in the concrete span or abutment for placement of small hydraulic jacks and bearing plates. More than one jack can be used in one throughbore. A jack can be positioned in a throughbore at an angle ranging from the vertical to 45° on either side of vertical for shifting the bridge hinge. The worn bridge bearing pads can either be replaced or left in place, with new bearing pads being added. The throughbores are either left unfilled or filled with concrete or steel pipes.

20 Claims, 4 Drawing Sheets

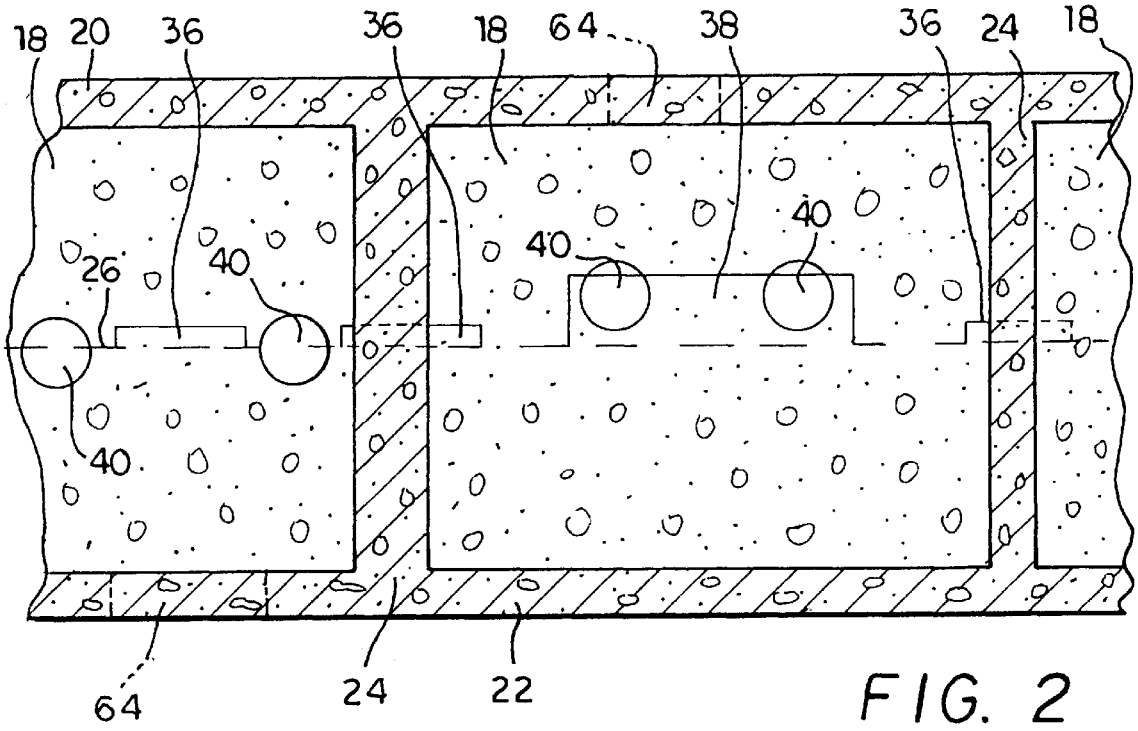
FIG. 2
FIG. 3
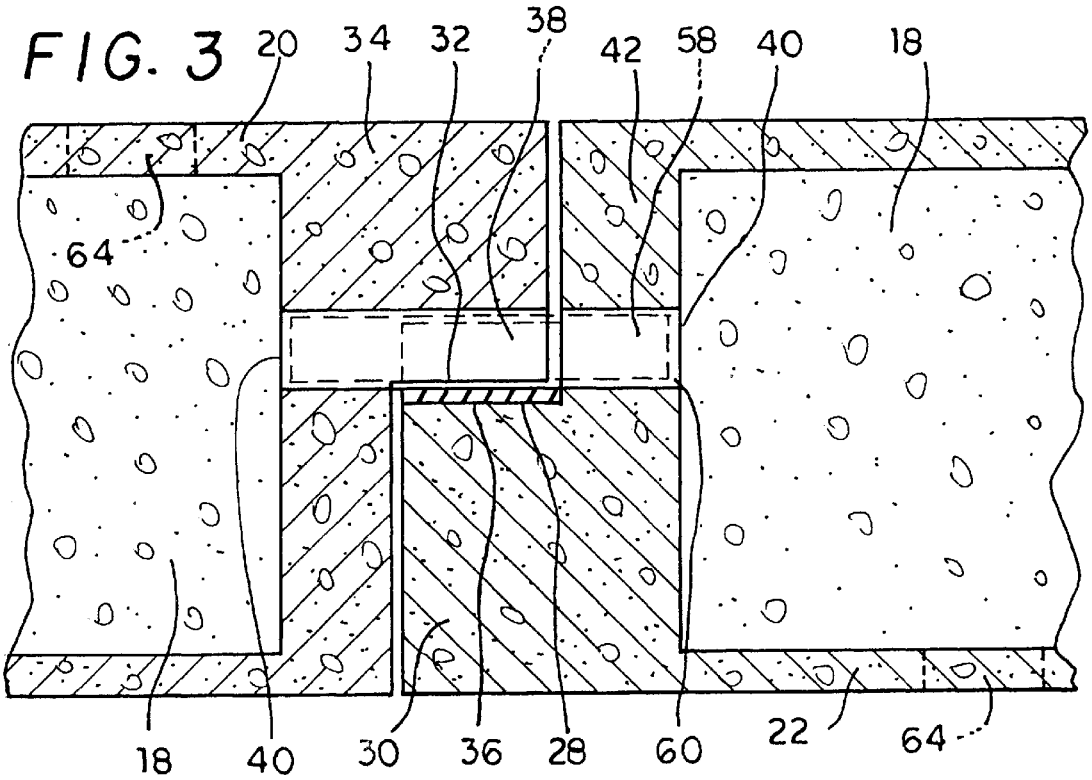

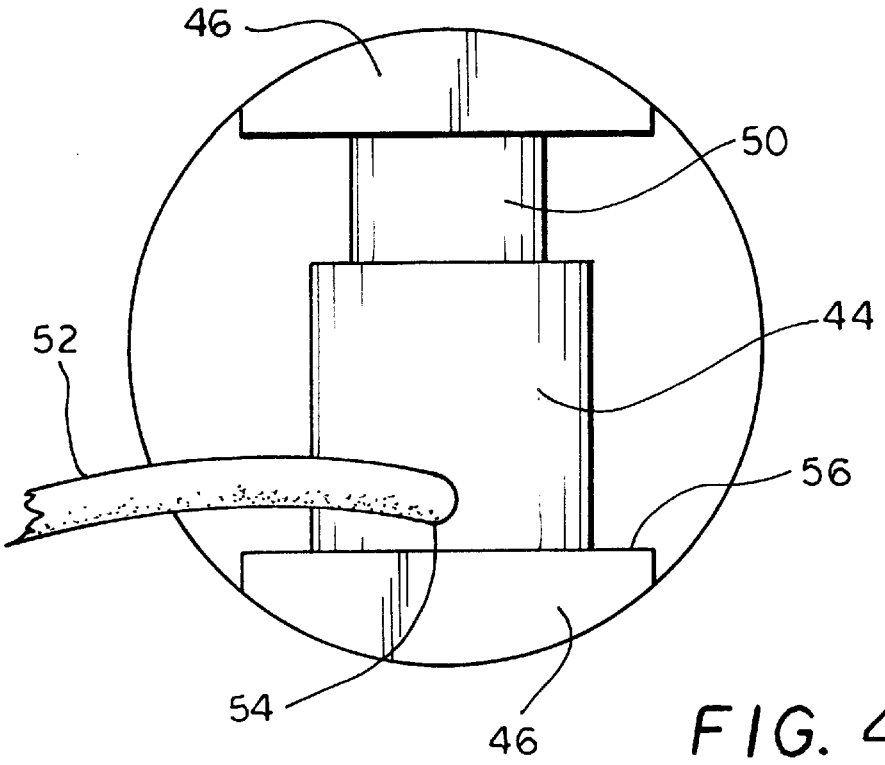
FIG. 4
FIG. 5
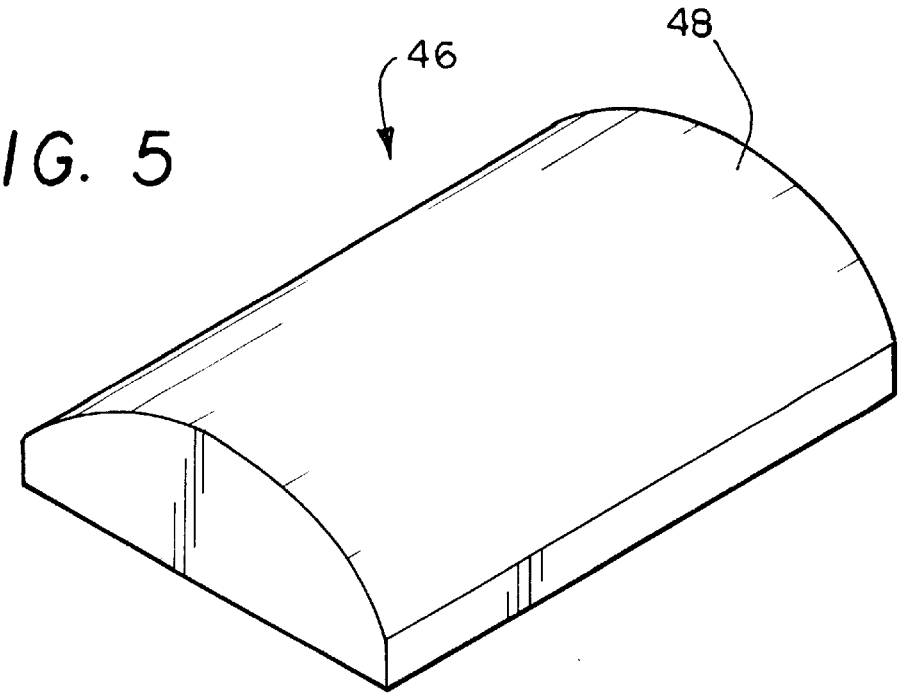

METHOD FOR REJUVENATING BRIDGE HINGES

BACKGROUND OF THE INVENTION

1. Field of the Invention

The present invention relates to an economical method for replacing bearing pads from bridge hinges and bridge abutments, and retrofitting seismic resistant structures with load-bearing pipes, with the aid of small hydraulic jacks.

2. Description of the Related Art

The related art shows various jacking techniques for construction of various structures. The art of interest will be discussed in the order of their perceived relevance to the present invention.

French Patent Application No. 2,576,948 published on Aug. 8, 1986, for Michel Guichard et al. describes a joint forming method for buildings by using hydraulic jacks in cylindrical cavities to hold the joint open while the filling sets. A row of cylindrical apertures of two different diameters are made along the line of the joint which are to be fitted together have hydraulic jacks with a pair of curved thrust plates inserted into each larger aperture. The jacks separate the joint for insertion of a sealant which is allowed to solidify before the jacks are removed. At first glance, one might conclude the processes are similar because hydraulic jacks and curved thrust plates are similar to the apparatus utilized in the present invention. However, the present invention is not utilizing the hydraulic jack in a horizontal position which would require strenuous effort to place the heavy hydraulic jack and the accompanying curved thrust plates in an upward direction into the cavity with the longitudinal axis of the jack held in a horizontal position by individual adjustment of each jack to stay in position. The present inventive method does not require an extended period for maintaining the separation of a joint as in the joint sealing method of the reference. There are no suggestions for (1) utilizing the jack in a different position for removal and insertion of a bearing pad or a pipe and (2) unifying the thrusts of the jacks in the separation process.

Japanese Patent No. 280,110 issued on Nov. 10, 1989, to Shinichi Yamazaki describes two methods for lifting a bridge girder from an abutment with a jack to permit the placement of a packing material. In the first method of FIGS. 1*a*–1*d*, a hanger is attached to the underside of a girder by a bolt in a lug of the hanger in a free space made available by a first saddle on a step. There is no suggestion for forming the existing access space by other means. As best understood, the hanger has a rotating bolt attached to the head of the jack. A second saddle is placed on top of the first saddle, the jack and the feed bench is retracted and rotated to permit the addition of a packing material under the jack. In the second embodiment of FIGS. 3*a*–3*g*, there is no hanger and a packing material is already under the jack. The jack is extended to add a second saddle on the step. The jack is removed and placed on a second packing material and extended presumably to add another saddle on the step. This reference is distinguished by the lack of forming an entry and in numerous repetitions of stroking the jack.

French Patent No. 2,544,432 issued Oct. 19, 1984, to Michel Placidi et al. describes a heavy duty hydraulic jack used to separate an aqueduct portion from an abutment by placing the jack horizontally with its head bolted onto the aqueduct portion lo increase the distance between the aqueduct portion and the abutment. There is no suggestion for forming an entry for replacement of elastomeric bearing pads as in the present invention.

European Patent Office Patent Application No. 423,029 published on Apr. 17, 1991, for Daniel Demarthe describes an obliquely positioned large ram installation for sliding a bridge section from land to piles. This huge jack and the process of using same are distinguished by its extreme size and different use.

U.S. Pat. No. 3,564,567 issued on Feb. 16, 1971, to Viliman Mladyenovitch describes a building method for multi-span structures utilizing timber towers topped with hydraulic jacks and ending with the end portions of the bridge.

U.S. Pat. No. 5,566,414 issued on Oct. 22, 1996, to Haluo (sic) Nonaka describes a bridge raising and supporting method and a device consisting of a wedge-shaped drive member cooperating with an upper wedge-shaped pressure receiving member attached to a sliding rod of a horizontally mounted hydraulic jack. A plate shaped shoe is inserted between the upper wedge member and the bridge structure. After wedging up the bridge structure, the jack portion is removed to leave in the wedges. There is no suggestion for forming holes to replace bearing pads in the bridge structure.

U.S. Pat. No. 3,685,224 issued on Aug. 22, 1972, to Pierre Launay describes a method of advancing a prestressed concrete bridging structure, i.e., a deck section, over piers by arranging two hydraulic jacks resting on neoprene plates on the shoulders of a concrete pier. Slide shoes which abut the deck section are made of reinforced elastomer with a bottom layer of tetrafluoroethylene and slide over a formation of three concrete slabs, wherein the center slab has a covering of a plate of stainless steel. The function of the jacks in this method appear to ensure that the slide shoes are not crushed and, therefore, have no relevance to the present invention.

None of the above inventions and patents, taken either singularly or in combination, is seen to describe the instant invention as claimed. Thus a jacking for bridge hinges solving the aforementioned problems is desired.

SUMMARY OF THE INVENTION

Presently, replacement of bearing pads at bridge hinges requires a temporary support system consisting of jacking towers to transfer the load to the ground or water floor while raising the span side of the hinge. Access to the bearing pads is then accomplished by demolishing the hinge back wall. The bearing pads are replaced, the hinge portion is reformed with concrete, and the jacking towers are then dismantled. In situations over water, the jacking towers are built on pilings with a platform, all of which must be removed after the operation. Furthermore, the bridge cannot be used during the reconstruction. Clearly, this present method is expensive, labor intensive and time-consuming.

The present economical and efficient invention as a first embodiment for a bridge over water involves coring two parallel holes (a foot in diameter and horizontally displaced) in the concrete structure of a bridge hinge cell from below the road surface and above the step of the lower hinge portion (hereafter referred to as an upright chair), placing at least one hydraulic jack vertically in each horizontal hole with specially configured metal bearing plates positioned above and beneath the jack for distributing the load, raising the upper hinge portion 1 to 6 inches by means of the jack, removing or leaving the deteriorated bearing pad depending on its condition, inserting the new bearing pad, and removing the jack. If necessary, two jacks can be employed in the same throughbore. The hydraulic jacks placed in one hinge are energized in unison by a power source and can be controlled by a computer.

As a second embodiment, the method can be applied for replacing the bearing pads between the bridge end and the abutment on the ground, wherein because of the configuration only a through bore through the bridge abutment seat is made.

As a third embodiment, the method can be applied to retrofit elevated roadways with pipes for seismic protection by opening holes from the deck and/or the soffit proximate to the hinges.

In a fourth embodiment, the hydraulic jack orientation in the hole can also be rotated up to 45° from the vertical initially to provide a horizontal force component for moving the upper hinge component sideways while lifting in conjunction with an engineered plan for such an operation.

Accordingly, it is a principal object of the invention to provide a method for replacing bearing pads of bridge hinges.

It is another object of the invention to provide a method wherein cored holes or throughbores are made in concrete structures for placement of small hydraulic jacks in a vertical position.

It is a further object of the invention to provide a method for replacing bearing pads of bridge abutments.

Still another object of the invention is to provide a method for the insertion of removable steel pipes in the seismic retrofitting of elevated roadways, which allow for inspection of the hinge interior and multiple bearing pad replacements.

Yet another object of the invention is to provide a method of aligning hinge joints by positioning the jacks initially in a position up to 45° from the vertical to shift and align the hinge joints.

It is an object of the invention to provide improved methods for rejuvenating bridge hinges or the like for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is a cross-sectional view of a bridge section as viewed along the roadway.

FIG. 3 is a cross-sectional side view of a bridge hinge showing the cored hole or throughbore and a shear key.

FIG. 4 is a front view of a small hydraulic jack supported by bearing plates in a cored hole or throughbore.

FIG. 5 is a perspective view of a bearing plate.

Similar reference characters denote corresponding features consistently throughout the attached drawings.

DETAILED DESCRIPTION OF THE PREFERRED EMBODIMENT

The present invention provides a method for removal and replacement of worn bearing pads or adding new reinforcement pipes at bridge hinges, bridge abutments and elevated roadways without relying on jacking towers as presently implemented. The invention as defined will describe the various joint structures as bridge joints.

Figure 1:
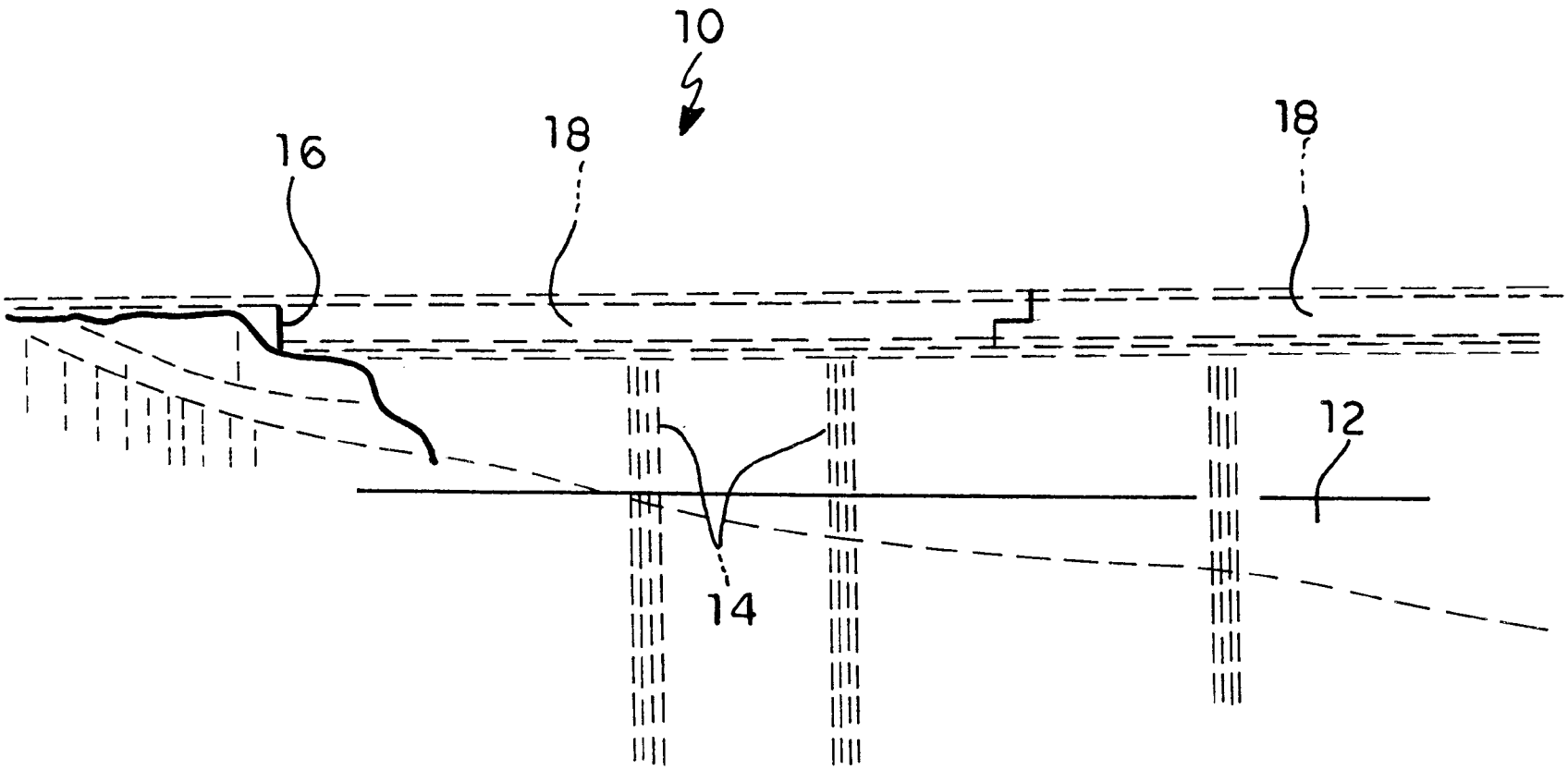
FIG. 1 is an environmental side view of a bridge portion with bridge hinges and an abutment.

FIG. 1 is an environmental schematic drawing of a section of a bridge 10 over a body of water 12 on footings or piers 14 and ending on an abutment 16. Two cells 18 (3–10 ft. deep) of the bridge 10 are shown. The present invention is not limited to bridges over water, but includes bridges over land and other roadways. The inventive process is applicable to roadways spanning 2 to 8 lanes, at the least.

FIGS. 2 and 3 are, respectively, a sectional view as viewed in the direction of the roadway and a sectional side view of a joint of two cells 18. In FIG. 2, a concrete cell 18 comprises a deck portion 20, a soffit portion 22 and walls or girders 24 approximately 12 inches thick. The configuration of the joints will be described in analogy to two chairs having seat backs and stacked together by inverting one of the chairs. The dashed line 26 in FIG. 2 represents the separation between the step or seat 28 of a first upright chair (configuration) 30 of a first cell 18 (FIG. 3) and the seat 32 of a second inverted chair 34. Bearing pads 36 are located between the respective seats 28, 32 of the chairs 30, 34 to absorb the shock of traffic and changes in temperature.

During the original bridge construction, galvanized steel pads (not shown) are also placed on the bearing pads 36. The elastomeric bearing pads 36 (typically 1 ft. by 2 ft. and 1–6 in. thick) are usually fabricated from vulcanized rubber layers which can compress from the original 4 inches to an inch, delaminate and can fail in effectiveness within approximately two years. The deteriorated condition of the bearing pads 36 is rendered obvious from the visual misalignment of the roadway at the hinges. Therefore, pads 36 must be either replaced or new pads must be placed on the shear keys 38. FIGS. 2 and 3 show concrete shear keys 38 (1–4 ft. in length and 1 ft. thick) which are part of the original structure formed during construction to facilitate the interlocking of cells to minimize sidewise shifting of the cells.

From examination of the original construction plans of the bridge, the approximate locations of the bearing pads 36 are duly noted, and a pair of 1 foot diameter holes or throughbores 40 are drilled accordingly in the proximity of each pad and on either side of a bearing pad. Access is thus made available to the deteriorated bearing pads 36 by drilling a first and second horizontal cylindrical throughbore 40 through the first cell 40 wall consisting of the seat back portion 42 above the first seat 28 and through the second seat portion 32 of the second cell wall at 34 (see FIG. 3). The total length of the first and second throughbores 40 can vary from 1.5 feet to over 4.5 feet.

Turning to FIG. 4, at least one small (7 inches in diameter) hydraulic jack 44, capable of lifting 100 tons or 5 tons per square inch, is inserted in each throughbore 40 in a vertical manner with bearing plates 46 (FIG. 5) placed above and below each jack. Each bearing plate 46 has a curved surface 48 with a radius of curvature of 6 inches to fit snugly against the cylindrical wall of the throughbore 40. The approximate dimensions of the steel or aluminum bearing plate 46 are 8 inches square, 2 inches at the maximum height and decreasing to ¾ inch at opposite sides. It has been found that the addition of an elastomer belt (not shown) of at least ⅛ inch in thickness placed between the surfaces of the throughbore 40 and the bearing plate 46 is desirable. Furthermore, the addition of one or more square flat steel bearing plates (not shown) approximately 7–16 inches on a side are placed between the jack 44 and the additional bearing plates 46 to maximize the load bearing support for the jack 44 to prevent damage to the throughbore 40. An additional jack 44 can be added in the same throughbore 40 to double the lifting capacity.

In FIG. 4, the hydraulic jacks 44 have an extension 50 and. a hydraulic line 52 extending from the port 54 at the base 56. The lifting operation of a bridge cell 18 can be performed by operating all the hydraulic jacks 44 simultaneously to extend 1–6 inches in height. Access to the deteriorating bearing pads 36 is thereby obtained through the throughbores 40 or optionally, left in place if in decent condition, and a new bearing pad 36 can be inserted. The bridge cells 18 are then lowered in unison, and the jacks 44 and the remaining paraphernalia such as the bearing plates 46 and other plates are removed. The throughbores 40 are either left unfilled or refilled with quick-setting concrete or steel pipes 58 (shown as a rectangular shadow line in FIG. 3).

Figure 6:
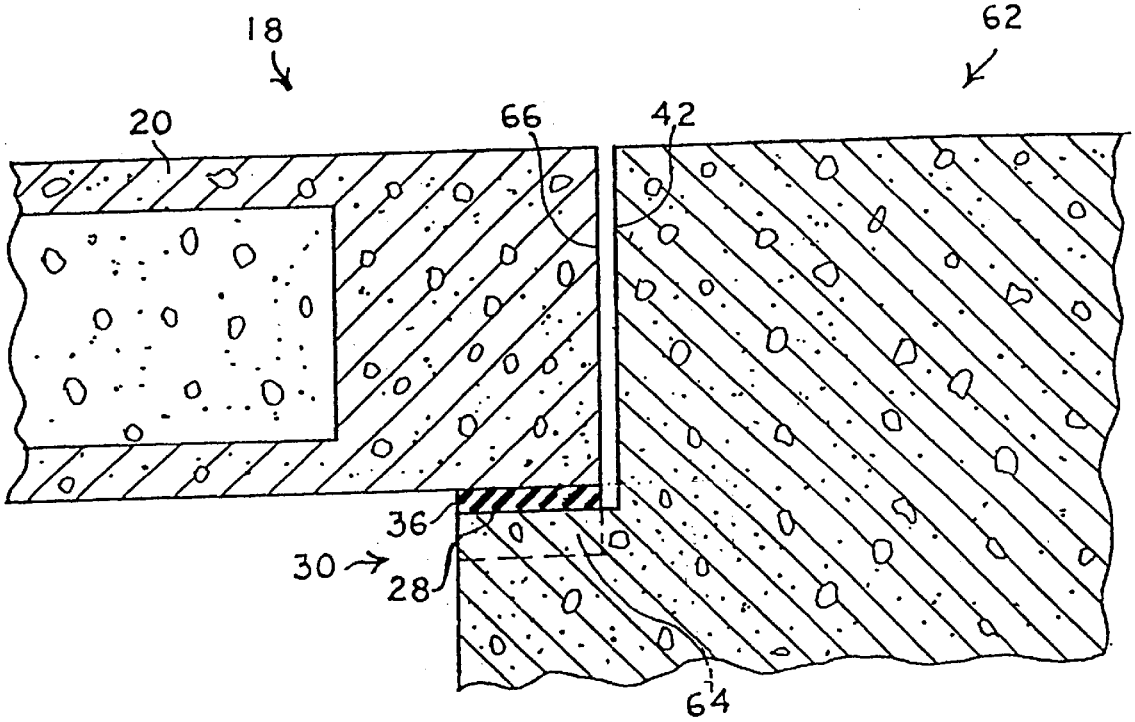
FIG. 6 is a cross-sectional view of a bridge abutment.

A second embodiment depicted in FIG. 6 concerns the ends of bridges wherein a squared cell end is positioned on a stepped abutment 62 on land. The process is similar to the extent that the boring of the throughbore is made only in the abutment seat before the girdle or soffit for access to the bearing pad.

A third embodiment concerns the emplacement of steel pipes 58 (shown in shadow in FIG. 3) on elevated roadways for seismic protection against earthquakes. Openings 2 feet square are made in the deck 20 and/or soffit 22 proximate to a hinge joint. After drilling throughbores 40 through the seatbacks 42 only, 8 inch diameter "double extra strong" pipes, typically used for seismic protection against earthquakes, are installed within 10 inch diameter "extra-strong" pipe sleeves 60 that are inserted and held by grouting in the throughbore 40.

A fourth embodiment concerns the correction of minor lateral shifting usually up to several inches of the bridge hinges. In a first step, after jacking up a hinge vertically and blocking, the jacks 44 and bearing plate 46 are rotated from the vertical in an amount not to exceed the concrete bearing capacity or 45° from the vertical and in the direction of the shift. The inverted chair 34 is raised vertically 1 or 2 inches and sideways with respect to the upright chair 30. In a second step, the sideways movement is maintained by inserting steel shims plates on the bearing pads 36 and lowering the inverted chair 34 to rest on the steel shim plate. In a third step, the jacks 44 and the bearing plates 46 are moved to the vertical position to raise the inverted chair 34 vertically and replacing the steel shim plates with new bearing pads 36. As the final step, the inverted chair 34 is lowered to rest again on the upright chair 30. The aforementioned process of rotating the jacks 44 and the bearing plates 46 is repeated if deemed necessary.

It is to be understood that the present invention is not limited to the embodiments described above, but encompasses any and all embodiments within the scope of the following claims.

We claim:

1. A method for rejuvenating bridge hinges having at least one shear key and at least one worn bearing pad comprising:

providing a concrete bridge hinge of at least one first cell having an upright chair edge with a back portion and a seat portion as a lower hinge joint, the upright chair mating with an inverted chair edge with a seat portion as an upper hinge joint of at least another second cell, and the seat portions being separated by the at least one worn bearing pad;

drilling a first horizontal cylindrical throughbore through at least one first cell at a location above the seat portion of the upright chair edge proximate to the worn bearing pad and drilling along the same horizontal axis to form a second cylindrical throughbore through the second cell and the inverted chair edge above its seat portion;

placing at least one small hydraulic jack in said second throughbore in a position ranging from the vertical to 45° from the vertical;

positioning a pair of conforming bearing plates above and below the at least one hydraulic jack;

lifting the seat portion of the inverted chair edge by extending the at least one hydraulic jack a predetermined distance and laterally shifting the position of the upper hinge when said lifting angle is other than the vertical;

replacing said worn bearing pad with a new bearing pad through the first throughbore; and lowering the at least one hydraulic jack extension to reseat the bridge hinge and removing the at least one hydraulic jack.

2. The method according to claim 1, wherein said first and second throughbores are left unfilled after removal of the at least one hydraulic jack.

3. The method according to claim 1, further including the step of refilling the first and second throughbores with a material selected from concrete and steel pipes after removal of the at least one hydraulic jack.

4. The method according to claim 1, including the step of placing the new bearing pad on top of the at least one shear key.

5. The method according to claim 1, including the step of adding a second small hydraulic jack in the second throughbore for increasing the lifting capacity.

6. The method according to claim 1, including the step of placing several flat plates between at least one of the pair of bearing plates and the bottom of the at least one hydraulic jack to provide a decrease in pressure in the throughbore and increasing the lifting capacity during the lifting step.

7. The method according to claim 1, wherein in aligning misaligned hinge joints, further including the steps of positioning the at least one hydraulic jack in said second throughbore up to 45° toward the shifted direction of the upper hinge joint, jacking the upper hinge joint up several inches, placing a steel shim plate on the bearing pad, lowering the hydraulic jack, repositioning the at least one jack in a vertical position and lifting the upper hinge joint, and replacing the steel shim plate with a new bearing pad.

8. A method for rejuvenating a bridge hinge at an abutment having at least one shear key and at least one worn bearing pad comprising:

providing a concrete bridge abutment step portion and an end of a concrete bridge cell having a seat of an inverted chair edge separated by a worn bearing pad;

drilling a horizontal cylindrical throughbore through the abutment at a location proximate to the worn bearing pad;

placing at least one small hydraulic jack vertically in said throughbore in a position ranging from the vertical to 45° from the vertical;

positioning a pair of conforming bearing plates above and below the at least one hydraulic jack;

lifting the seat portion of the inverted chair edge by extending the at least one hydraulic jack a predetermined distance and laterally shifting the position of the concrete bridge cell when said lifting is other than the vertical;

replacing the worn bearing pad with a new bearing pad through said throughbore, and lowering the at least one hydraulic jack extension to reseat the bridge hinge and removing the hydraulic jack.

9. The method according to claim 8, wherein said throughbore is left unfilled after removal of the at least one hydraulic jack.

10. The method according to claim 8, further including the step of refilling the throughbore with a material selected from concrete and steel pipes after removal of the at least one hydraulic jack.

11. The method according to claim 8, including the step of placing the new bearing pad on top of the at least one shear key.

12. The method according to claim 8, including the step of adding a second small hydraulic jack in the throughbore for increasing the lifting capacity.

13. The method according to claim 8, including the step of placing several flat plates between at least one of the pair of the conforming bearing plates and the bottom of the at least one hydraulic jack to provide a decrease in pressure in the throughbore and increasing the lifting capacity during the lifting step.

14. A method for rejuvenating elevated roadway hinges having at least one shear key and at least one worn bearing pad comprising:

providing a concrete roadway hinge of at least one first cell with a deck and soffit, and having an upright chair edge with a back portion and a seat portion, the upright chair mating with an inverted chair edge with a seat portion of at least another second cell, and the seat portions being separated by the at least one worn bearing pad;

providing an access hole through either the deck or the soffit;

probing the roadway hinge to locate the at least one worn bearing pad;

drilling a first horizontal cylindrical throughbore through the at least one first cell at a location above the seat portion of the upright chair edge proximate to the worn bearing pad and drilling along the same horizontal axis to form a second cylindrical throughbore through the at least another second cell and the inverted chair edge above its seat portion;

placing at least one small hydraulic jack in said second throughbore in a position ranging from the vertical to 45° from the vertical;

positioning a pair of conforming bearing plates above and below the at least one hydraulic jack;

lifting the seat portion of the inverted chair edge by extending the at least one hydraulic jack a predetermined distance and laterally shifting the position of the hinge when said lifting is other than the vertical;

inserting a seismic resistant pipe through the first throughbore and placing the pipe between the seat portions; and lowering the extension of the at least one hydraulic jack to reseat the bridge hinge and removing the at least one hydraulic jack.

15. The method according to claim 14, wherein said first and second throughbores are left unfilled after removal of the at least one hydraulic jack.

16. The method according to claim 14, further including the step of refilling the first and second throughbores with a material selected from concrete and steel pipes after removal of the at least one hydraulic jack.

17. The method according to claim 14, including the step of placing a new bearing pad on top of the shear key.

18. The method according to claim 14, including the step of adding a second small hydraulic jack in the second throughbore for increasing the lifting capacity.

19. The method according to claim 14, including the step of placing several flat plates between at least one of the pair of the conforming bearing plates and the bottom of the at least one small hydraulic jack to provide a decrease in pressure in the throughbore and increasing the lifting capacity during the lifting step.

20. The method according to claim 14, wherein the lifting step includes the synchronizing of multiple hydraulic jacks to lift the inverted chair edge of an elevated roadway span.

* * * * *